US009200637B2

(12) United States Patent
Aiello

(10) Patent No.: US 9,200,637 B2
(45) Date of Patent: Dec. 1, 2015

(54) METHOD FOR CORRECTION OF IMPELLER UNBALANCE OF A COOLING FAN

(71) Applicant: Apple Inc., Cupertino, CA (US)

(72) Inventor: Anthony Joseph Aiello, Santa Cruz, CA (US)

(73) Assignee: Apple Inc., Cupertino, CA (US)

( * ) Notice: Subject to any disclaimer, the term of this patent is extended or adjusted under 35 U.S.C. 154(b) by 204 days.

(21) Appl. No.: 13/665,222

(22) Filed: Oct. 31, 2012

(65) Prior Publication Data

US 2014/0119960 A1 May 1, 2014

(51) Int. Cl.
*F04D 29/66* (2006.01)
*F04D 29/28* (2006.01)

(52) U.S. Cl.
CPC ..... *F04D 29/281* (2013.01); *F04D 29/662* (2013.01); *Y10T 29/49004* (2015.01)

(58) Field of Classification Search
CPC ... F04D 29/662; F04D 29/281; F04D 29/329; F04D 29/263; Y10S 416/50
USPC ..... 416/144, 145, 500, 190, 246
See application file for complete search history.

(56) References Cited

U.S. PATENT DOCUMENTS 3,500,090 A * 3/1970 Baermann ..... 310/154.14
4,003,265 A * 1/1977 Craig et al. ..... 74/5 R
4,624,597 A * 11/1986 Johnson et al. ..... 403/16
5,927,947 A * 7/1999 Botros ..... 416/144
6,172,439 B1 * 1/2001 Ishizuka ..... 310/156.27
6,362,551 B1 * 3/2002 Horng ..... 310/156.21
6,707,639 B1 * 3/2004 Pfeiffer et al. ..... 360/99.08
7,456,541 B2 11/2008 Horng et al.
7,919,893 B2 * 4/2011 Horng et al. ..... 310/156.26
8,109,713 B2 2/2012 Horng et al.
2005/0012418 A1 * 1/2005 Chou et al. ..... 310/156.08
2006/0083619 A1 * 4/2006 Roever et al. ..... 416/145
2006/0233646 A1 10/2006 Vidal et al.
2007/0014675 A1 * 1/2007 Nagamatsu et al. ..... 417/354
2007/0253820 A1 * 11/2007 Liu ..... 416/144
2010/0215505 A1 * 8/2010 Takeshita ..... 416/223 R
2011/0108251 A1 5/2011 Horng
2013/0004304 A1 1/2013 Teshima et al.

* cited by examiner

*Primary Examiner* — Nathaniel Wiehe
*Assistant Examiner* — Eldon Brockman
(74) *Attorney, Agent, or Firm* — Downey Brand LLP

(57) ABSTRACT

The described embodiments relate generally to cooling fans and more specifically to a method for balancing an impeller assembly included in a cooling fan. In one embodiment, a balancing ring with an asymmetric shape can be included in an impeller assembly and rotated to correct an unbalance in the impeller assembly. In another embodiment, a balancing ring assembly can be provided including an inner balancing ring and an outer balancing ring. The size and shape of the inner balancing ring can be modified to better correct any unbalance in the impeller assembly.

23 Claims, 6 Drawing Sheets

METHOD FOR CORRECTION OF IMPELLER UNBALANCE OF A COOLING FAN

FIELD OF THE DESCRIBED EMBODIMENTS

The described embodiments relate generally to cooling fans and more specifically to a method for balancing an impeller assembly included in a cooling fan.

BACKGROUND

In electronic devices such as computers, cooling fans play an important role in maintaining stable operating conditions by preventing components from overheating. Often, cooling fans can include an impeller assembly mounted within a housing. The impeller assembly can include a ring magnet forming a rotor and the housing can include one or more wound stators. The interaction between the magnetic fields formed by the rotor and the stators can give rise to a torque, causing the impeller to rotate relative to the housing. When the impeller assembly is not balanced about a rotational axis, the rotation of the impeller can induce a vibrational force on the cooling fan and any surrounding structure.

These vibrations can cause acoustic noises and vibrations that are unpleasant for a user of the device. Moreover, vibrations can reduce the efficiency of the device and increase wear on bearings and other mechanical connections. The vibrations can be reduced by balancing the impeller assembly about its rotational axis during the assembly process. The balancing can be accomplished by measuring a radial acceleration for the impeller assembly while it is rotating and then adding or subtracting mass from specific areas of the rotor to achieve an acceptable balance. However, this process can be costly and time consuming, particularly in a high volume manufacturing environment.

Therefore, what is desired is a fast and efficient way to balance an impeller assembly in a cooling fan during an assembly process.

SUMMARY OF THE DESCRIBED EMBODIMENTS

In one embodiment, a method for correcting an impeller unbalance in a cooling fan is disclosed. The method includes at least the following steps: (1) receiving an impeller assembly including an impeller and a magnet, (2) analyzing the balance of the impeller assembly and an outer balancing ring using a balancing machine, and (3) coupling an asymmetric balancing ring to the impeller assembly at an orientation configured to reduce the unbalance in the impeller assembly. The asymmetry of the balancing ring can counteract any difference between the center of mass for the impeller assembly and a rotational axis about which the impeller assembly rotates, reducing vibrational forces resulting from the unbalance.

In another embodiment, a different method for correcting an impeller imbalance in a cooling fan is disclosed. The method includes at least the following steps: (1) receiving an impeller assembly including an impeller and a magnet, (2) coupling an outer balancing ring including a plurality of interlocking features to the impeller assembly, (3) analyzing the balance of the impeller assembly and outer balancing ring using a balancing machine, (4) selecting an inner balancing ring with interlocking features configured to engage with the outer balancing ring and a size and shape configured to counteract any unbalance in the impeller assembly, and (5) coupling the inner balancing ring to the outer balancing ring at an angle configured to reduce the unbalance to within a required threshold that corresponds to an acceptable vibration level.

In yet another embodiment, an impeller assembly is described. The impeller assembly can include an impeller, a magnet, and a balancing ring. The impeller can further include a central hub, a plurality of fan blades extending outwardly from a periphery of the central hub, and a circular recess in one side of the central hub. The magnet and the balancing ring can be disposed within the recess. The balancing ring can be formed in a circular arc with an opening at one end and a tab opposite the opening. This opening and tab can be oriented to counteract any difference between a combined center of mass for the impeller and magnet and a rotation axis for the impeller assembly.

In still another embodiment, an alternative impeller assembly is described. The impeller assembly can include an impeller, an outer balancing ring, and an inner balancing ring. The impeller can further include a central hub, a plurality of fan blades extending outwardly from a periphery of the central hub, and a circular recess in one side of the central hub. The outer balancing ring can be positioned within the circular recess and can include a plurality of interlocking features on an inner surface. The inner balancing ring can also be disposed within the recess. Furthermore, the inner balancing ring can be formed in a circular arc with an opening at one end and a plurality of interlocking features on an outer surface. The inner balancing ring can be oriented such that the asymmetry resulting from the opening can counteract any unbalance in the impeller assembly. Moreover, the interlocking features of the inner and outer balancing rings can allow the inner balancing ring to remain in position relative to the outer balancing ring Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings. These drawings do not limit any changes in form and detail that may be made to the described embodiments. Any such changes do not depart from the spirit and scope of the described embodiments.

DETAILED DESCRIPTION OF SELECTED EMBODIMENTS

Figure 1:
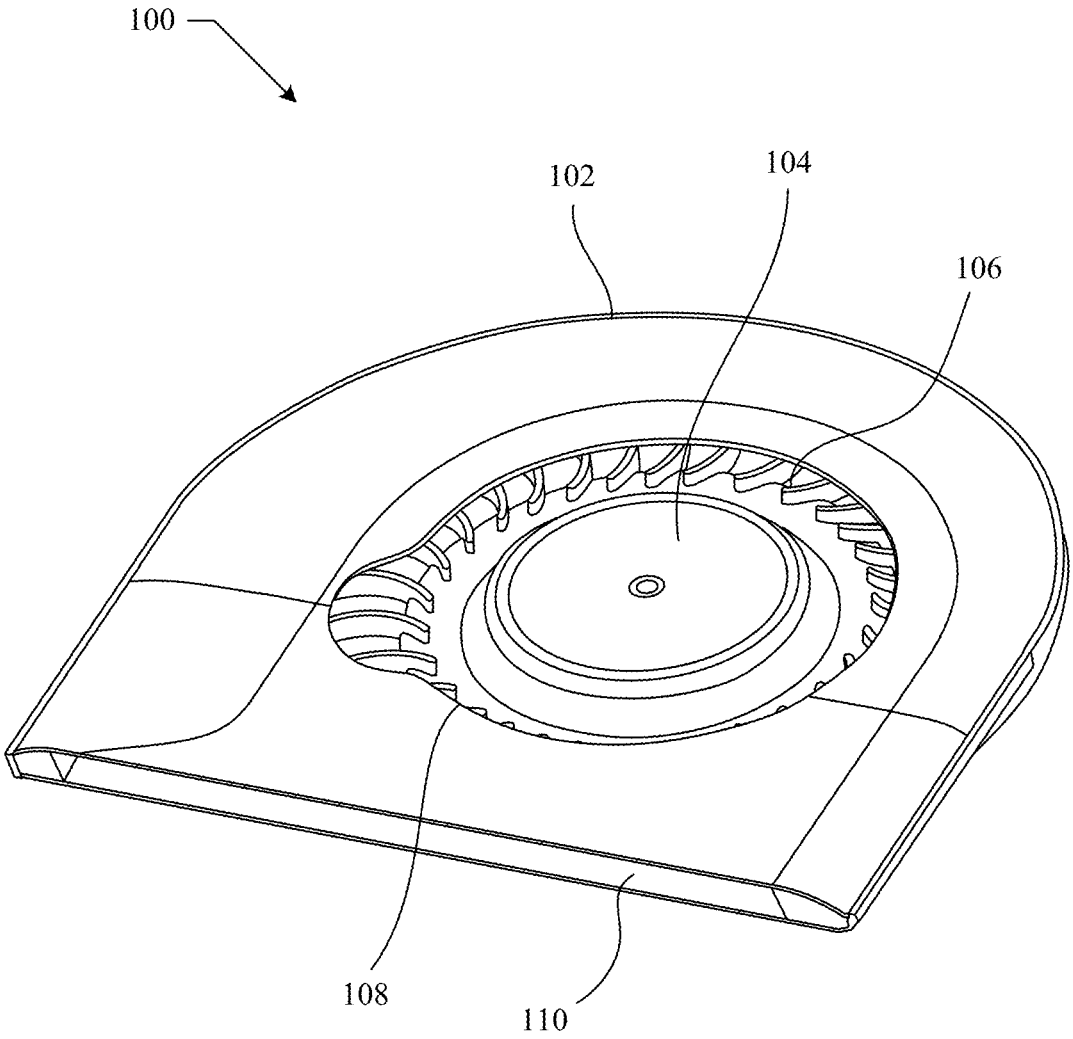
FIG. 1 shows an isometric view of a cooling fan assembly.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Many electronic devices contain cooling fans to regulate the temperature of electronic components contained within the device. These cooling fans can include an impeller assembly including an impeller coupled to a magnet. The cooling fan can also include a housing containing a wound stator. As current flows through the stator winding coils, a magnetic field is formed that interacts with the magnet coupled to the impeller, creating a torque that drives the impeller's rotation. The impeller assembly can be attached to the housing using a bearing that allows the impeller assembly to rotate relative to the housing about a rotation axis or any other technically feasible means for attaching a rotating component. When the impeller assembly is not balanced, the rotation can produce a vibration with a magnitude dependent on the degree of unbalance and the mass of the impeller assembly.

In order to reduce this vibration to within an acceptable threshold, the impeller assembly unbalance can be measured during production and corrected by adding mass at a specific angular location and radial distance from the rotation axis. A typical method for correcting the balance of an impeller assembly can include adding a clay-based compound to certain areas of the impeller. This additional mass can be added repeatedly in an iterative process until the measured unbalance amount is within an acceptable threshold. This process can include multiple mass applications and retests, which is time consuming and therefore costly. It can therefore be desirable to devise a method to add the correct amount of mass at the correct angular location only once.

The acceptable threshold for unbalance within the impeller assembly can vary depending on the size, shape, and application of the impeller. For example, impellers formed from relatively heavy materials such as metal can generate more vibrational force than a relatively lighter impeller with a similar center of mass. Moreover, the resilience of the bearings and surrounding structure can limit the amount of vibrational force that can be allowed in a particular application. In some scenarios, a design standard such as ISO 1940 can be used to determine an acceptable threshold for unbalance in the impeller and the corresponding vibrational forces.

In one embodiment, an apparatus and method are disclosed for balancing an impeller assembly during a manufacturing process. A balancing ring can be mechanically coupled to the impeller assembly between the impeller and the magnet. The balancing ring can include a tab at one end and a space at another end so that the mass of the balancing ring is distributed asymmetrically. The balancing machine can be used to analyze the balance properties of the impeller and a positioning jig can orient the balancing ring to counteract unbalance within the impeller assembly. In another embodiment, the impeller assembly can include an outer balancing ring and an inner balancing ring with interlocking features to couple the outer balancing ring to the inner balancing ring. The inner balancing ring can have varying shapes and masses to counteract a wider range of unbalances in the impeller assembly.

FIG. 1 shows cooling fan assembly 100, demonstrating one application in which the disclosed method can be used. Housing 102 can form an exterior surface for cooling fan assembly 100. Housing 102 can include a top cover arranged at a top side of impeller 106 and a bottom cover approximately parallel to the top cover and arranged at a bottom side of impeller 106. In one embodiment, housing 102 can also include side walls for connecting the top cover to the bottom cover. Air inlet 108 can include an opening in a central portion of the top cover for allowing air to enter cooling fan assembly 100. In another embodiment, a second air inlet opening can also be included in a central portion of the bottom cover. Air outlet 110 is disposed in one side of cooling fan assembly 100 and is oriented approximately perpendicularly to air inlet 108.

An impeller assembly including impeller 106 and hub 104 can be disposed within housing 102 and can rotate relative to housing 102 about a rotational axis through the center of hub 104. Impeller 106 can include a plurality of fan blades extending radially and outwardly from an outer periphery of impeller 106. The fan blades can be shaped to draw air in through air inlet 108 and out through air outlet 110 when the impeller assembly is rotated. The impeller assembly can also include a magnet within hub 104 that can interact with a stator contained within the interior of housing 102 to produce a torque on the impeller assembly, causing the impeller assembly to rotate during operation of cooling fan assembly 100.

Figure 2:
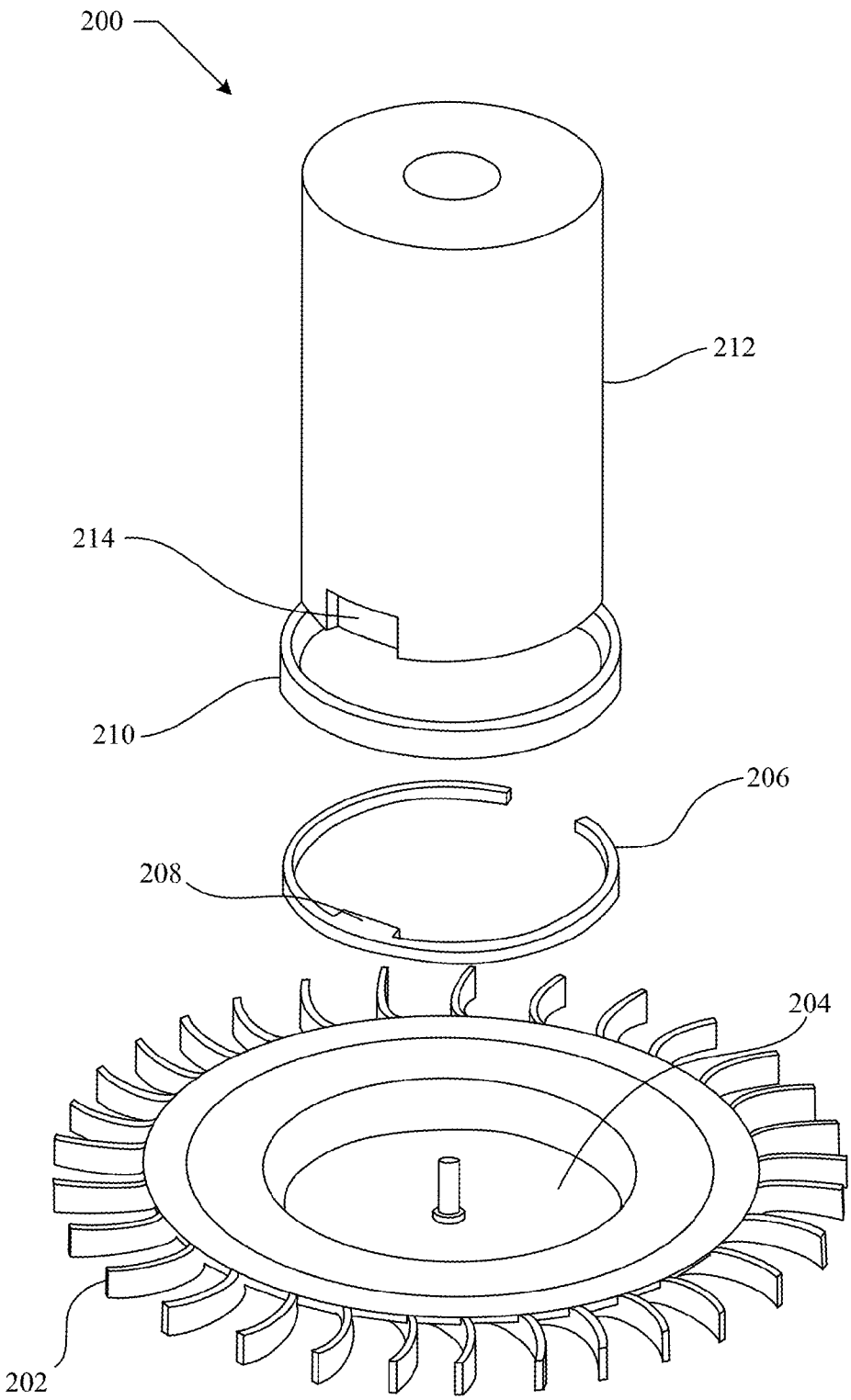
FIG. 2 shows an exploded view of an impeller assembly and a positioning jig.

FIG. 2 shows an exploded view of impeller-magnet assembly process 200 that can be used in assembling a cooling fan such as cooling fan assembly 100. Impeller 202 can include a number of blades designed to move air in a specified direction when impeller 202 is rotated. Impeller 202 can be formed from a plastic, metal, or any other feasible material. Recess 204 can be included in impeller 202 to provide space for balancing ring 206 and magnet 210. In one embodiment, balancing ring 206 can be disposed below magnet 210 and can act as a spacer to ensure that magnet 210 is placed in a correct position relative to a stator contained in the housing of the cooling fan. In other embodiments, balancing ring 206 can be disposed above magnet 210 or on an opposite side of impeller 202 from magnet 210. Furthermore, balancing ring 206 can include tab 208 and an opening across from tab 208. As a result, balancing ring 206 can have an asymmetric mass about the axis of rotation, allowing balancing ring 206 to counteract any unbalance in impeller 202 and magnet 210. When balancing ring 206 is positioned below magnet 210, it can be advantageous for balancing ring 206 to have an arc length of at least 180 degrees and less than 360 degrees so sufficient contact area between magnet 210 and balancing ring 206 can be provided to form a bond.

The size and shape of tab 208 and the opening in balancing ring 206 can be sized to counteract an average amount of unbalance in impeller 202 and magnet 210 that is typical in a given manufacturing process. Accordingly, balancing ring 206 can be composed of various materials having different weights. For example, balancing ring 206 can be formed from plastic if small corrections are needed and can be formed from a heavier material such as steel if larger corrections are needed. If balancing ring 206 is formed from steel, it can be necessary to select a non-magnetic form of steel to prevent balancing ring 206 from interfering with the magnetic field generated by magnet 210.

During the manufacturing process, the impeller assembly can be analyzed using a balancing machine. The balancing machine can rotate the impeller assembly about the rotation axis and measure a resulting amount of vibration using a sensor such as an accelerometer. Furthermore, a sensor can be used to determine the exact rotational speed and the relative phase of the rotating part relative to the vibrations. By analyzing the time difference between the phase of the rotating part and the vibration peak, the balancing machine can calculate the angle at which the unbalance exists. Furthermore, the magnitude of the vibrations can be used to calculate an amount of weight that can be added at a fixed distance from the rotation axis to correct the unbalance.

After determining a direction and magnitude of balance using the balancing machine, positioning jig 212 can be used to position balancing ring 206 at an orientation so that the asymmetric mass of balancing ring 206 cancels out some or all of the unbalance in the impeller assembly. Positioning jig 212 can include opening 214. Opening 214 can be configured to interlock with tab 208 on balancing ring 206 during an assembly process. Then, positioning jig 212 can rotate balancing ring 206 to the correct angle before balancing ring 206 is mechanically coupled to impeller 202. Tab 208 and opening 214 are depicted as being rectangular. However, any interlocking set of shapes can be used including trapezoidal shapes, triangular shapes, or any other feasible shape. Once in position, balancing ring 206 can be mechanically coupled to impeller 202 using any technically feasible means including adhesives, press-fit, ultrasonic welding, and fasteners.

One disadvantage to impeller-magnet assembly process 200 can be that the mass correction amount for balancing ring 206 is fixed. In another embodiment, this problem can be alleviated by providing a number of different types of balancing rings. For example, different balancing rings can include different weights, thicknesses, or geometry. Then, balancing rings with more mass or more asymmetric geometry can be used to counteract large unbalances. Similarly, balancing rings with less mass and less asymmetric geometry can be used to counteract small unbalances in impeller 202. In another embodiment, these different balancing rings can be color coded according to the amount of asymmetry that they provide to aid in the manufacturing process.

Figure 3:
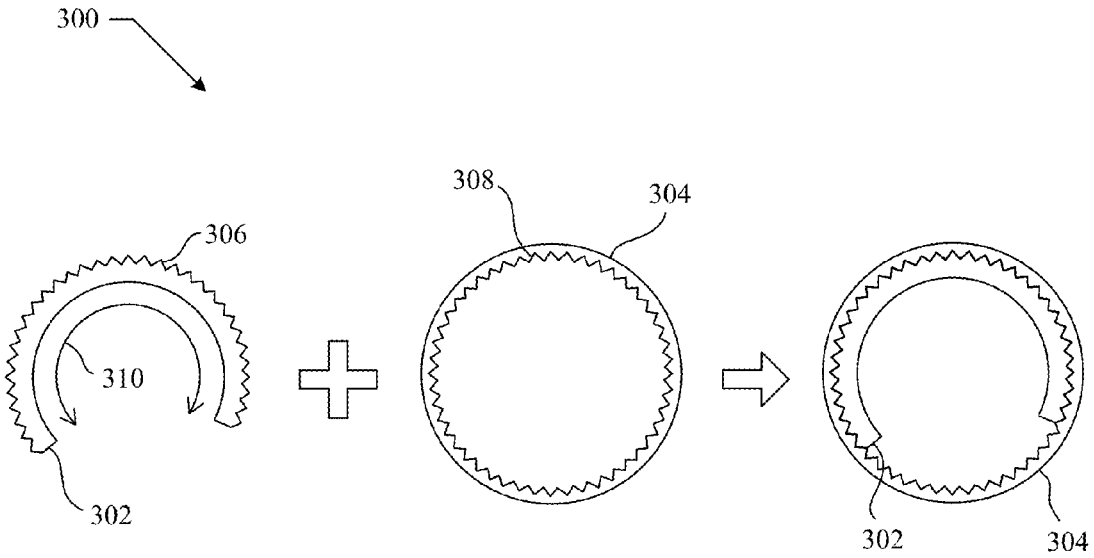
FIG. 3 shows a balancing ring assembly.

FIG. 3 shows balancing ring assembly 300, demonstrating another embodiment of the present disclosure. Inner balancing ring 302 can include a circular arc extending through arc length 310 and interlocking features 306 placed along an outer surface. Interlocking features 306 can include any geometry capable of mating with a similar but opposite feature. For example, interlocking features 306 can be triangular, square, trapezoidal, or any other technically feasible shape. Furthermore, interlocking features 306 do not need to be continuous along an outer surface of inner balancing ring 302. For example, as few as approximately three triangular protrusions spaced at regular intervals along an outer surface of inner balancing ring 302 can be sufficient to prevent movement relative to a mating part.

Various versions of inner balancing ring 302 can be created, including variations with different thicknesses and different values of arc length 310. Moreover, variations made from different materials can be included to vary the weight of inner balancing ring 302. In one embodiment, the thickness of inner balancing ring 302 can be allowed to vary along arc length 310. For example, balancing ring 302 can be relatively thinner near the endpoints of arc length 310 and relatively thicker near a center portion of arc length 310. The non-uniform thickness can change the center of mass of inner balancing ring 302 if doing so is necessary to balance the impeller assembly. In one embodiment, different variations of inner balancing ring 302 can have exterior surfaces with different colors or markings to aid an operator in selecting a correct ring. Additionally, outer balancing ring 304 can be provided. Outer balancing ring 304 can include a circle with interlocking features 308 on an interior surface. Interlocking features 308 can be configured to align with interlocking features 306 in inner balancing ring 302, preventing movement between the inner and outer balancing rings.

Figure 4:
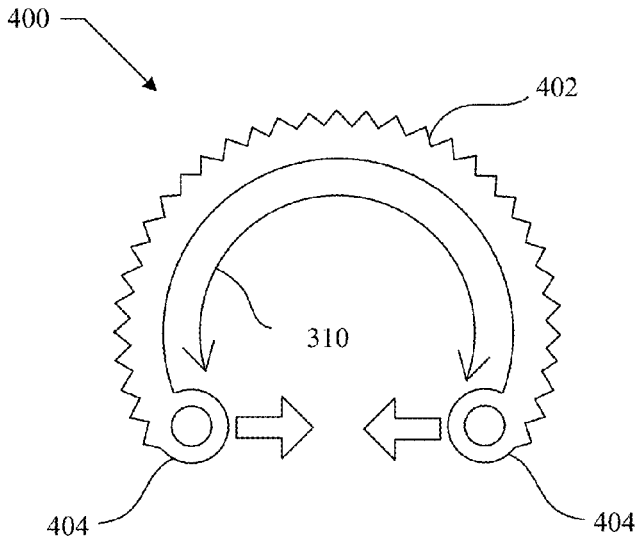
FIG. 4 shows an inner balancing ring.

FIG. 4 shows inner balancing ring 400, demonstrating another embodiment of the present disclosure. Inner balancing ring 400 can have a length defined by circular arc 310 and can include interlocking features 402 and tabs 404. In some embodiments, installation of inner balancing ring 302 into outer balancing ring 304 can be difficult unless inner balancing ring 302 is made to collapse. When this is the case, inner balancing ring 400 can be used. Inner balancing ring 400 can be formed from a flexible material such as plastic. During an installation process, tabs 404 can be pulled inward in the direction of the arrows. The resulting force can reduce the radius of circular arc 310 while inner balancing ring 400 is positioned within outer balancing ring 304. In one embodiment, arc length 310 can have a value of at least 180 degrees and less than 360 degrees to allow inner balancing ring 400 to spring back and provide sufficient retention between interlocking features on inner balancing ring 400 and outer balancing ring 304. Once inner balancing ring 400 is in position, tabs 404 can be released and inner balancing ring 400 can expand, allowing interlocking features 402 on inner balancing ring 400 to engage with corresponding interlocking features 308 on outer balancing ring 304. The compression of inner balancing ring 400 during installation into outer balancing ring 304 can allow inner balancing ring 400 to be held in place by its own tension, which can be used as the primary means of retaining inner balancing ring 400, or as a temporary means until a more permanent fixing means such as adhesive or a magnet attraction force between the magnet and the impeller can be applied.

Figure 5:
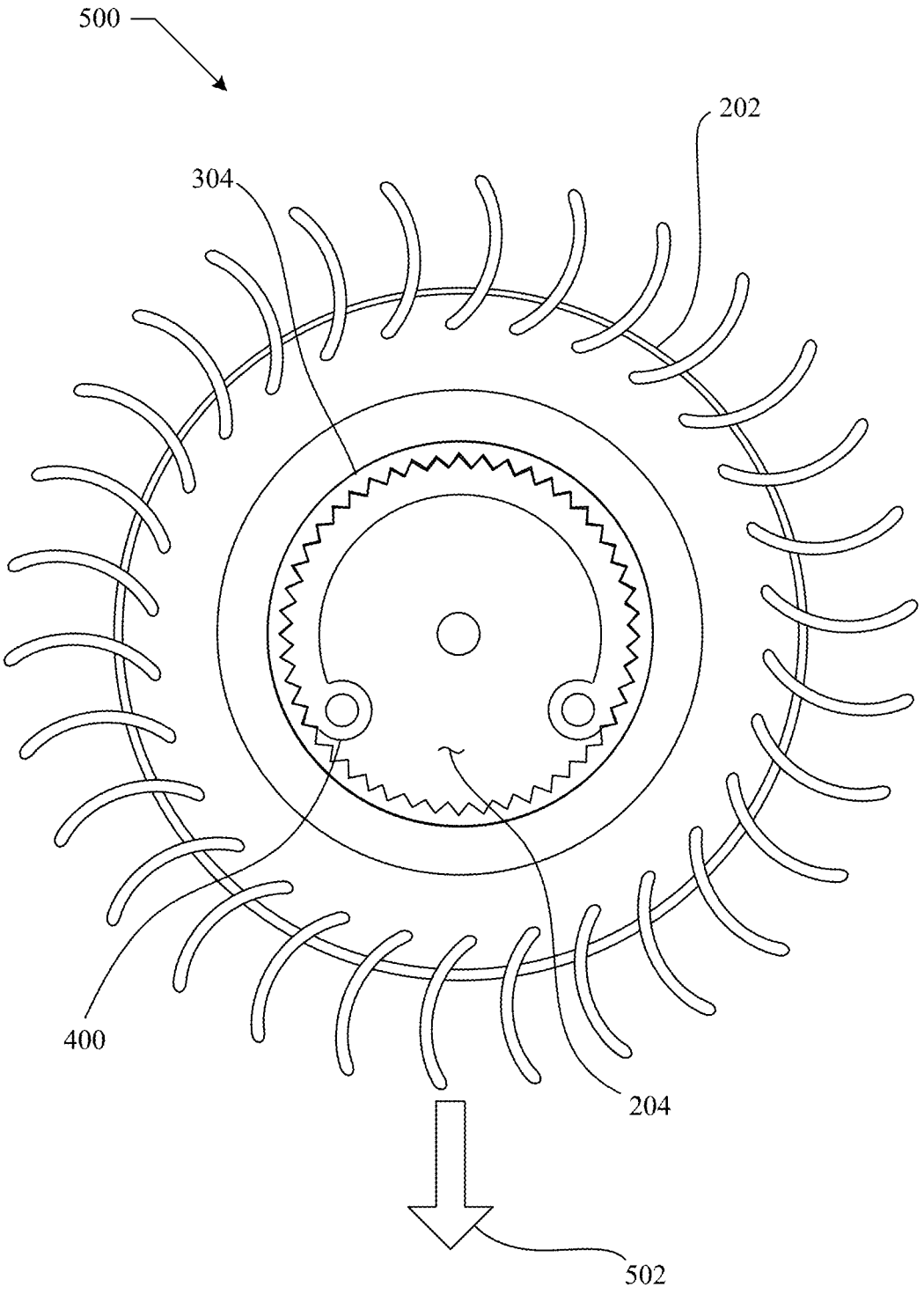
FIG. 5 shows an impeller assembly including inner and outer balancing rings.

FIG. 5 shows impeller assembly 500, demonstrating how inner balancing ring 400 and outer balancing ring 304 can be included with impeller 202. Outer balancing ring 304 can be positioned within recess 204 and coupled to impeller 202. In one embodiment, outer balancing ring 304 can act as a spacer for positioning magnet 210 relative to impeller 202. Outer balancing ring 304 can be mechanically coupled to impeller 202 and magnet 210 (not shown in FIG. 5 for clarity) using any technically feasible means such as adhesive, press-fit, or fasteners. In another embodiment, outer balancing ring 304 can be incorporated into impeller 202. For example, the interlocking features of outer balancing ring 304 can be molded into recess 204 in impeller 202, negating the need to install outer balancing ring 304 during the assembly process.

Once outer balancing ring 304 is coupled to impeller 202 and magnet 210 has been installed, the impeller assembly can be analyzed using a balancing machine. Based on the results, a variant of inner balancing ring 400 can be selected with a weight and amount of geometric asymmetry configured to best counteract any unbalance detected in the impeller-magnet assembly. For example, a variant of inner balancing ring 306 made from a heavier material, having a thicker cross section, or having an arc length slightly more than 180 degrees can be used to correct large unbalances. Conversely, a variant of inner balancing ring 306 made from a lighter material such as a plastic, having a thinner cross section, or having an arc length closer to 360 degrees can be used to correct small unbalances in the impeller assembly. Inner balancing ring 400 can be mechanically coupled to outer balancing ring 304 using adhesives, fasteners, or any other suitable means. During installation, the angular orientation of inner balancing ring 400 can be positioned relatively opposite to the measured angular direction of the impeller-magnet assembly's unbalance force 502 to reduce the unbalance in the impeller assembly 500. The desired angular orientation and unbalance correction mass can be output by the balancing machine.

Figure 6:
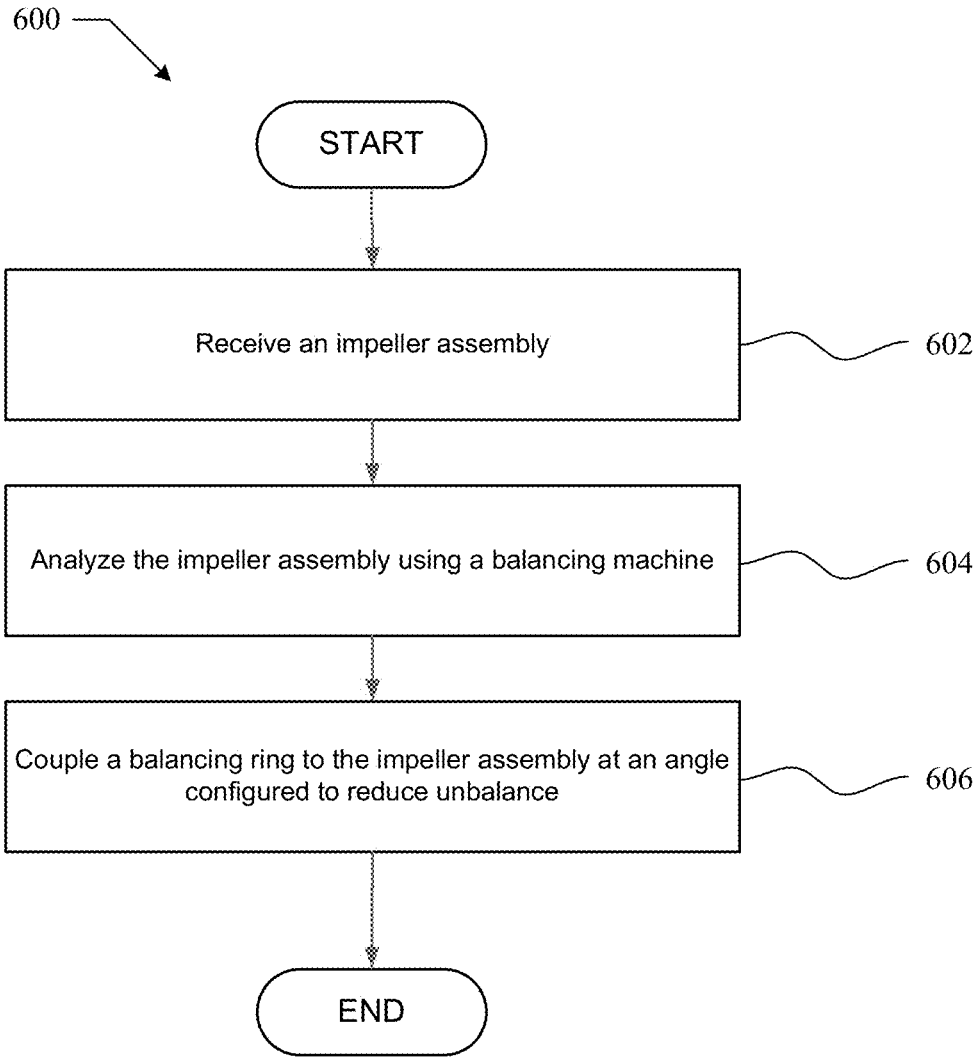
FIG. 6 shows a flow chart describing a process for balancing an impeller assembly.

FIG. 6 shows a flow chart describing process 600 for balancing an impeller assembly in accordance with the described embodiments. In step 602, an impeller assembly can be received. The impeller assembly can include an impeller and a magnet or other components. In step 604, the impeller assembly and outer balancing ring can be analyzed using a balancing machine to determine a magnitude and orientation of any unbalance about a rotational axis. Finally, in step 606, a balancing ring with an asymmetric shape can be coupled to the impeller assembly at an angle configured to reduce the unbalance in the impeller assembly. Using this process, the impeller unbalance can be corrected to within a desired threshold within a shorter amount of time by only applying a correction mass once. A significant processing advantage can be realized relative to the prior art method of applying a small amount of clay-based compound repeatedly and iterating until the desired unbalance mass correction is achieved.

Figure 7:
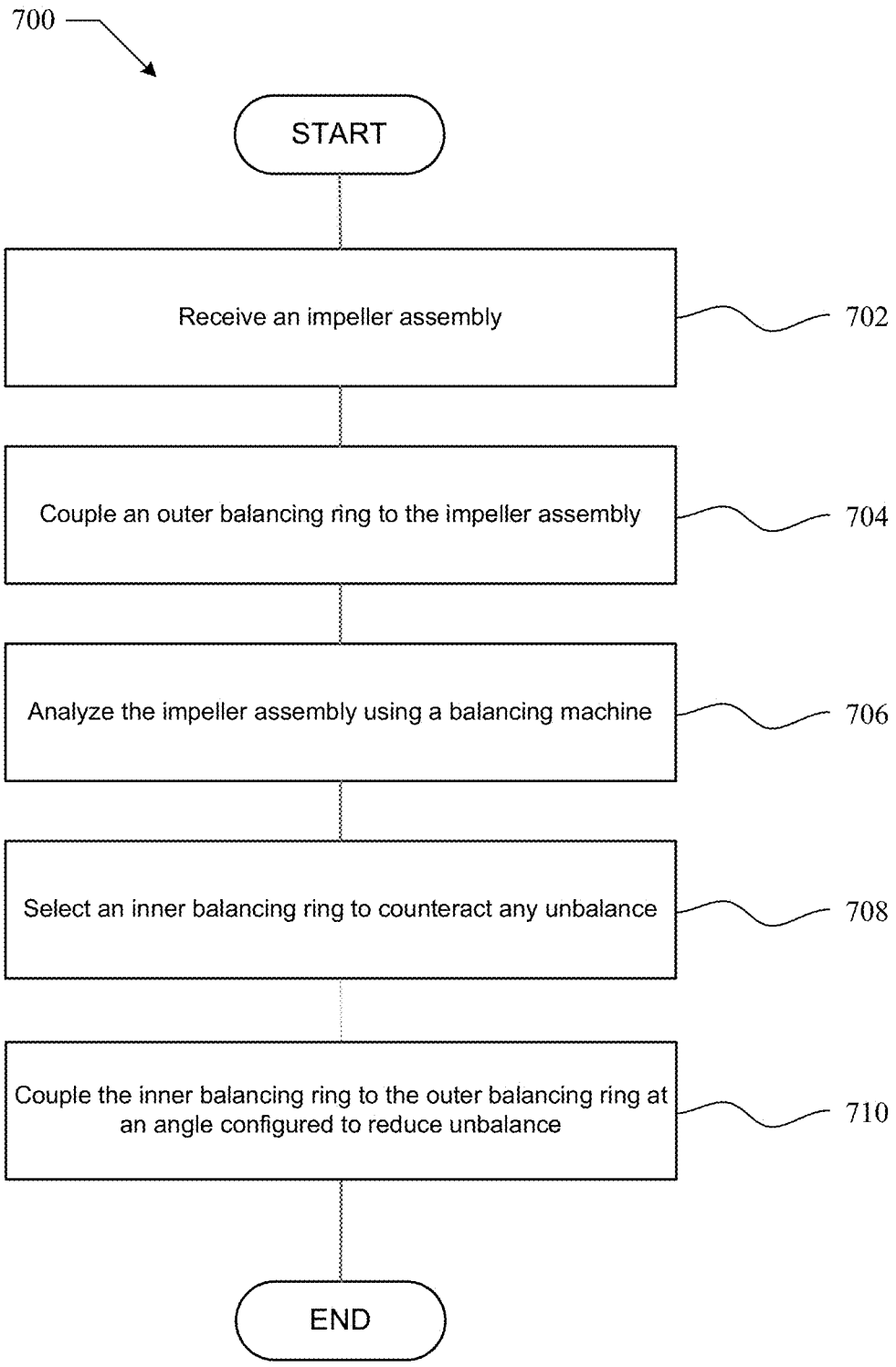
FIG. 7 shows a flow chart describing a process for balancing an impeller assembly.

FIG. 7 shows a flow chart describing process 700 for balancing an impeller assembly in accordance with the described embodiments. In step 702, an impeller assembly can be received. The impeller assembly can include an impeller and a magnet or other components. In step 704, an outer balancing ring can be coupled to the impeller assembly. The outer balancing ring can include a plurality of interlocking features along an inner surface. In one embodiment, the outer balancing ring can also act as a spacer between the impeller and the magnet. In yet another embodiment, the outer balancing ring can be incorporated into the impeller assembly, negating the need for step 704. In step 706 the impeller assembly and outer balancing ring can be analyzed using a balancing machine to determine a magnitude and orientation of any unbalance about a rotational axis. In step 708, an inner balancing ring can be selected to counteract the unbalance detected by the balancing machine. Various inner balancing rings with varying arc lengths, thicknesses, and materials can be made available to address a wide range of unbalance values. Moreover, the inner balancing rings can include interlocking features configured to mate with the interlocking features of the outer balancing ring. Finally, in step 610, the inner balancing ring can be coupled to the outer balancing ring and oriented at an angle configured to reduce an amount of unbalance in the impeller assembly.

Additionally, for impellers that are relatively taller with respect to their outer diameter as compared to impeller 202 in FIG. 2, the unbalance can be corrected at two planes spaced apart axially along the rotational axis in order to achieve a desired vibration performance (known as dual-plane balancing). In such cases, two sets of inner and outer balance rings can be used and process 700 can be applied for each of these upper and lower unbalance correction positions on the impeller assembly. For example, a second recess similar to recess 204 can be provided on an opposite surface of impeller 202 and an additional balancing ring can be located in the second recess. In another embodiment, either of the recesses can include the features of outer balancing ring 304 integrally formed as part of the impeller so that outer balancing rings 304 do not need to be installed.

The various aspects, embodiments, implementations or features of the described embodiments can be used separately or in any combination. Various aspects of the described embodiments can be implemented by software, hardware, or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for balancing an impeller assembly in a cooling fan, the method comprising:

analyzing an impeller assembly, that includes (i) an impeller configured to rotate about an axis and (ii) a magnet that is disposed within a recess of a central hub of the impeller assembly, for an amount of unbalance in the impeller assembly and determine a quantity and position of weight that can be added to the impeller assembly to reduce the amount of unbalance; and coupling, based on the analyzing, an outer balancing ring and an inner balancing piece to the impeller assembly such that the inner balancing piece is disposed within a perimeter of the outer balancing ring and both the outer balancing ring and inner balancing piece are located between the magnet and the recess and both abut a surface of the recess.

2. The method as recited in claim 1, wherein the inner balancing piece includes an arc angle that is greater than or equal to 180 degrees and less than 360 degrees.

3. The method as recited in claim 1, wherein the outer balancing ring sets a spacing of the magnet relative to the impeller.

4. The method as recited in claim 1, wherein the outer balancing ring includes a tab on one side that results in an asymmetric weight distribution.

5. The method as recited in claim 4, wherein the tab included in the outer balancing ring is configured to interlock with an opening in a positioning jig that rotates the outer balancing ring to an angle that reduces the unbalance of the impeller assembly to within a required threshold during an assembly process.

6. A method for balancing an impeller assembly in a cooling fan, the method comprising:

analyzing an impeller assembly, the impeller assembly comprising an impeller, a magnet, a central hub having a recess, and an outer balancing ring, wherein the outer balancing ring includes a first set of protruding features radially extending toward a center of the outer balancing ring, wherein:

(i) the analyzing comprises detecting an amount of unbalance in the impeller assembly and determining a quantity and position of weight that can be added to the impeller assembly to reduce the unbalance, and (ii) the outer balancing ring includes a first set of protruding features radially extending toward a center of the outer balancing ring;

selecting, based on the analyzing, an inner balancing piece, wherein:

(i) the inner balancing piece includes an inner arc and a second set of protruding features that extend away from a center of the inner balancing piece, and (ii) the second set of protruding features are configured to mate with the first set of protruding features in the outer balancing ring; and coupling the inner balancing piece co-planar to, and within a perimeter of, the outer balancing ring to reduce the unbalance of the impeller assembly, wherein both of the outer balancing ring and the inner balancing piece abut a surface of the recess.

7. The method as recited in claim 6, wherein the inner balancing piece includes an arc angle that is greater than or equal to 180 degrees and less than 360 degrees.

8. The method as recited in claim 7, wherein the inner balancing piece is relatively thicker in a region approximately opposite an opening in the inner balancing piece and relatively thinner in regions near the ends of the inner balancing piece.

9. The method as recited in claim 8, further comprising:

forming the inner balancing piece from a flexible material;

compressing the inner balancing piece while positioning the inner balancing piece relative to the outer balancing ring; and releasing the compression when the inner balancing piece is aligned at an angle configured to reduce the unbalance of the impeller assembly to within a required threshold.

10. The method as recited in claim 9, wherein the inner balancing piece is held in place at least temporarily by tension created between the inner balancing piece and outer balancing ring when the compression is released.

11. The method as recited in claim 9, wherein the inner balancing piece includes tab features and is compressed by pulling the tab features inward.

12. The method as recited in claim 7, wherein the outer balancing ring is coupled to the impeller using an adhesive.

13. The method as recited in claim 6, wherein the outer balancing ring is formed integrally with the impeller.

14. The method as recited in claim 6, further comprising:

including a second outer balancing ring in the impeller assembly, wherein the second outer balancing ring includes a first plurality of protruding features and is oriented parallel to the outer balancing ring and disposed a distance from the outer balancing ring;

selecting a second inner balancing piece with a size and weight sufficient to reduce the amount of unbalance in a plane parallel to the second outer balancing ring, wherein the second inner balancing piece includes a second plurality of protruding features configured to mate with the first plurality of protruding features in the second outer balancing ring and prevent rotation of the second inner balancing piece relative to the second outer balancing ring; and coupling the second inner balancing piece to the second outer balancing ring using the protruding features of the second inner balancing piece and the second outer balancing ring, wherein the inner balancing piece and the second inner balancing piece are placed at an orientation configured to reduce the unbalance of the impeller assembly in two planes.

15. An impeller assembly, comprising:

an impeller including a central hub, a plurality of fan blades extending outwardly from a periphery of the central hub, and a recess in at least one side of the central hub, wherein the impeller is configured to rotate about a rotational axis;

a magnet disposed within the recess;

an outer balancing ring; and an inner balancing piece disposed within a perimeter of the outer balancing ring, wherein both of the outer balancing ring and the inner balancing piece are located between the magnet and the recess and both abut a surface of the recess.

16. The impeller assembly as recited in claim 15, wherein each of the outer balancing ring and the inner balancing ring has a different outermost radius.

17. The impeller assembly as recited in claim 16, further comprising a tab configured to engage with an opening in a positioning jig that is capable of rotating the inner balancing piece to a correct orientation.

18. An apparatus for balancing an impeller assembly that includes a central hub, a plurality of fan blades extending outwardly from a periphery of the central hub, and a recess in at least one side of the central hub, the apparatus comprising:

an outer balancing ring located within the recess, wherein the outer balancing ring includes a first set of protruding features radially extending toward a center of the outer balancing ring; and an inner balancing piece located within a perimeter of the outer balancing ring, the inner balancing piece comprising: i) an inner arc and ii) a second set of protruding features radially extending away from a center of the inner balancing piece, wherein both of the outer balancing ring and the inner balancing piece abut a planar surface of the recess, and wherein the first set of protruding features is configured to engage with, and be co-planar to, the second set of protruding features to balance the impeller assembly.

19. The apparatus as recited in claim 18, wherein each of the outer balancing ring and inner balancing ring has a different outermost radius.

20. The apparatus as recited in claim 18, wherein the outer balancing ring is formed integrally with a part of the impeller assembly that rotates.

21. The apparatus as recited in claim 18, wherein the outer balancing ring is coupled to the central hub using an adhesive.

22. The apparatus as recited in claim 18, further comprising a magnet, wherein the inner balancing piece is disposed between the magnet and the recess of the at least one side of the central hub relative to a central axis of the central hub.

23. The apparatus as recited in claim 18, further comprising:

a second outer balancing ring in the impeller assembly, wherein the second outer balancing ring includes a first plurality of protruding features and is oriented parallel to the outer balancing ring and disposed a distance from the outer balancing ring; and a second inner balancing piece with a size and weight sufficient to reduce an amount of unbalance in a plane parallel to the second outer balancing ring, wherein the second inner balancing piece includes a second plurality set of protruding features configured to mate with the first plurality of protruding features in the second outer balancing ring and prevent rotation of the second inner balancing piece relative to the second outer balancing ring.

* * * * *